United States Patent [19]

Yanaka et al.

[11] Patent Number: 5,066,327

[45] Date of Patent: Nov. 19, 1991

[54] METHOD FOR MANUFACTURING COLD BONDED PELLETS

[75] Inventors: Hideomi Yanaka; Yotaro Ohno, both of Kawasaki, Japan

[73] Assignee: NKK Corporation, Tokyo, Japan

[21] Appl. No.: 535,496

[22] Filed: Jun. 11, 1990

[30] Foreign Application Priority Data

Jun. 20, 1989 [JP] Japan ..... 1-155687

[51] Int. Cl.[5] ..... C22B 1/243

[52] U.S. Cl. ..... 75/770; 75/468; 75/773

[58] Field of Search ..... 75/773, 770, 468

[56] References Cited

U.S. PATENT DOCUMENTS 3,617,254 11/1971 Imperato et al. ..... 75/773

FOREIGN PATENT DOCUMENTS 48642 3/1983 Japan ..... 75/773
61-253330 11/1986 Japan .
62-56536 3/1987 Japan .
62-74028 4/1987 Japan .
62-177133 8/1987 Japan .

*Primary Examiner*—Melvyn J. Andrews
*Attorney, Agent, or Firm*—Fleit, Jacobson, Cohn, Price, Holman & Stern

[57] ABSTRACT

A method for manufacturing cold bonded pellets comprises the steps of mixing fine iron ore with binder and pelletizing the mixture of the fine iron ore and the binder to manufacture green pellets, charging the green pellets into a travelling grate, a layer of the green pellets which has a predetermined height being formed on the travelling grate, blowing gas containing carbon dioxide into the layer of the green pellets on the travelling grate, the green pellets being cured by the gas containing carbon dioxide, and the gas having passed through the layer of the green pelllets being discharged, and drying the curen green pellets. The gas containing carbon dioxide has a concentration of 55 vol. % carbon dioxide or more. The gas containing carbon dioxide has a concentration of 20 vol. % nitrogen or less. The gas containing carbon dioxide is blown into the green pellets layer at a flow rate of 0.1 to 1.0 $Nm^3$/sec. for 1 $m^2$ of the area of the grate, $Nm^3$ being the volume of the gas in a normal condition.

8 Claims, 1 Drawing Sheet

METHOD FOR MANUFACTURING COLD BONDED PELLETS

BACKGROUND OF THE INVENTION

1. Field of the Invention

The present invention relates to a method for manufacturing cold bonded pellets.

2. Description of the Prior Art

As the publicly known prior art methods for manufacturing cold bonded pellets, two curing methods are pointed out. The one is an atmospheric curing method, and the other is a curing method which utilizes mainly a hydration bond.

According to the first method, fine iron ore, powdery coke and cement are mixed with each other, green pellets obtained by pelletizing the mixture thereof are stacked up in a yard and cured in the atmosphere. In this method, equipment necessary for the curing of the green pellets is only a yard of a predetermined area, but there is a problem such that it takes around ten days for the curing.

According to the second method, green pellets are charged into a shaft, a curing gas containing 25 vol. % $CO_2$, 25 vol. % $H_2O$ and 50 vol. % $N_2$ is circulated in the shaft to cure the green pellets by a hydration reaction, and the green pellets cured are charged into a second shaft to be dried. In the second method, time for the curing of the green pellets can be reduced to around ten hours, but a number of shafts should be prepared to manufacture a great amount of cold bonded pellets.

SUMMARY OF THE INVENTION

It is an object of the present invention to provide a method for manufacturing cold bonded pellets which can shorten the period of curing green pellets and reduce an equipment cost.

To attain the aforementioned object, the present invention provides the method for manufacturing cold bonded pellets comprising the steps of:

mixing fine iron ore with binder and pelletizing the mixture of the fine iron ore and the binder, green pellets being manufactured;

charging said green pellets into a travelling grate, a layer of the green pellets which has a predetermined height being formed on the travelling grate;

blowing gas containing carbon dioxide into the layer of the green pellets on the travelling grate, the green pellets being cured by the gas containing carbon dioxide, and the gas having passed through the layer of the green pellets being dishcharged; and drying the cured green pellets.

The above objects and other objects and advantages of the present invention will become apparent from the detailed description which follows, taken in conjunction with the appended drawings.

DESCRIPTION OF THE PREFERRED EMBODIMENT

Figure 1:
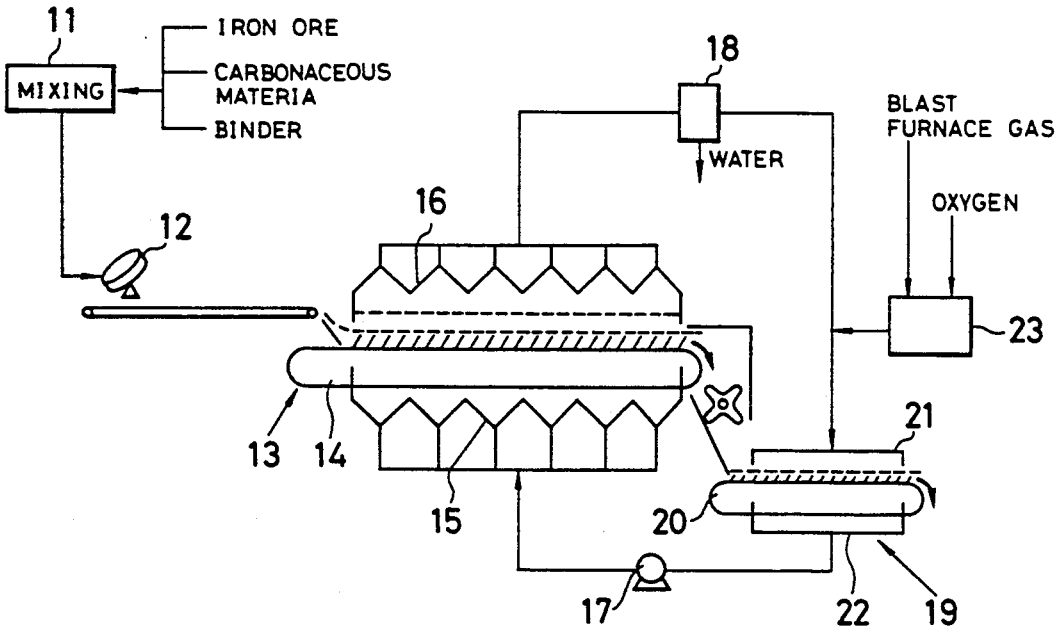
FIG. 1 is a schematic illustration showing an apparatus used for the execution of the method of the present invention.

Referring now specifically to the appended drawing, an example of the present invention will be described. Iron ore such as fine ore is mixed with carbonaceous material such as hard coal or powdery coke and binder such as cement in a mixer 11. The mixture thereof is pelletized into green pellets of a predetermined size by the use of a pelletizer 12. The particle size of said green pellets is in the range of from 5 to 20 mm. Moisture contained in the green pellets is around 8%. Subsequently, said green pellets are charged into the travelling grate 13. The travelling grate 13 has a conveyer 14, wind boxes 15 positioned under the conveyer 14, a fan 17 and wind boxes 16 positioned above the conveyer 14. The curing gas is supplied into the wind boxes 15 by the fan 17. The supplied curing gas is blown into the layer of the green pellets formed on the conveyer 14 through the wind boxes 15. The gas having passed through the layer of the green pellets is sucked into the wind boxes 16. While the curing gas is passing through the layer of the green pellets, the green pellets are cured by the curing gas containing carbon dioxide.

The following three cases of combinations of materials for the green pellets are thinkable: (a) iron ore and binder, (b) iron ore, binder and carbonaceous material, (c) iron ore, binder, carbonaceous material and flux.

In the case of (b), since carbonaceous material is contained in the cold bonded pellets as the final products, the reduction property of the cold bonded pellets during the use of them in a blast furnace becomes good. In the case of (c), a slag content in the cold bonded pellets is regulated, and the high-temperature property of said pellets is improved.

The concentration of carbon dioxide in the curing gas is desired to be 55 vol. % or more for carbonation curing of the green pellets. The concentration of carbon dioxide in the curing gas is preferred to be 90 vol. % or more. Because the green pellets are sufficiently cured when the concentration of carbon dioxide in the curing gas is 55 vol. % or more. When the curing gas is circularly used and a great amount of nitrogen gas is contained in the curing gas, the curing gas is desired to be periodically changed for a fresh curing gas to prevent nitrogen gas from accumulating in the curing gas. In the present invention, the concentration of nitrogen gas is desired to be 20 vol. % or less to prevent nitrogen gas from accumulating in the curing gas. The curing gas containing carbon dioxide is desired to be blown into the green pellets layer at a flow rate of 0.1 to 1.0 $Nm^3$/sec for 1 $m^2$ of the travelling grate. $Nm^3$ is the volume of gas in its normal condition. When the flow rate of the curing gas is less than 0.1 $Nm^3$/sec, it takes much time for the curing of the green pellets.

As the curing gas containing carbon dioxide, a combustion gas, which is obtained by combusting a blast furnace gas generated in a blast furnace process with oxygen is, desirable. In said blast furnace process, iron ore and coke are charged from the top of the blast furnace into the blast furnace and pure oxygen gas is blown from tuyeres into the blast furnace to manufacture pig iron. Because nitrogen gas is substantially not contained in the blast furnace gas generated in the aforementioned blast furnace process. The combustion gas can be used, being mixed with the curing gas having passed through the travelling grate. Said combustion gas as it is can be used as the curing gas.

According to the method of the present invention, the curing gas having passed through the travelling grate is dehydrated by a cooling dehydrator 18, mixed with combustion gas, and blown into a dryer 19. The dryer 19 has a conveyer 20, wind boxes 21 for blowing a drying gas which are positioned above the conveyer 20, and wind boxes 22 for sucking the drying gas having been used for drying the green pellets, which are positioned under the conveyer 20. The gas having been used for drying the green pellets is used as the curing gas. The combustion gas is the gas obtained by combusting the gas, which is generated from the top of the blast furnace in said blast furnace process, with oxygen in a combustor 23.

The pellets are charged into the dryer 19 after the curing. The pellets after the curing which are on a travelling conveyer 20 are dried by the drying gas. The moisture in the pellets is substantially decreased to 0% by the drying. The drying gas used for the drying is introduced into the wind boxes 15 for sucking by the fan 17 as the curing gas.

Subsequently, an example of the present invention will now be described specifically. A mixture of 1.4 t of fine iron ore, 0.25 t of hard coal and 0.1 t of cement was pelletized in green pellets of around 10 mm in particle size containing 9% of moisture. Said green pellets were charged into the travelling grate of 5 m in breadth and 80 m in length so that the layer of the green pellets can have a predetermined height. The height of the layer in the range of 0.5 to 1 m is desired. The retention time of the green pellets for 0.5 to 1 hour is desired in the range of said height of the layer. The green pellets were cured by blowing the curing gas of 70° C. having the concentration of 90% carbon dioxide and 0% nitrogen from the fan 17 for blowing the curing gas into the layer of the green pellets at a flow rate of $43\times10^4$ $Nm^3$/hr, or at a flow rate of 0.3 $Nm^3$/sec. for 1 $m^2$ of the area of the grate. The cured pellets were charged into the dryer. The gas having passed through the layer of the green pellets was of 70° C., had the concentration of 83% carbon dioxide, and flowed at a rate of $45.1\times10^4$ $Nm^3$hr. The gas having passed through the layer of the green pellets was dehydrated by the dehydrator, by which 44.2 t of water was removed. The gas, from which water had been removed, was of 30° C., had the concentration of 95% carbon dioxide, and flowed at a rate of $39.6\times10^4$ $Nm^3$/hr. A drying gas of 90° C. was obtained by mixing combustion gases obtained by combusting the gas after the dehydration and a blast furnace gas generated in the blast furnace process with oxygen. The composition of the blast furnace gas was 30% CO, 55% $CO_2$, 5% $H_2$ and 10% $H_2O$. The amounts of the blast furnace gas, oxygen and the drying gas were $1.4\times10^4$ $Nm^3$/hr, $0.245\times10^4$ $Nm^3$/hr and $41\times10^4$ $Nm^3$/hr, respectively. The drying gas was blown into the layer of the cured pellets on the dryer to dry the cured pellets. The gas after the drying of the pellets was returned to the grate, thus being circularly used as the curing gas. In this way, the cold bonded pellets were manufactured at a rate of 14400 t/day (600 t/hr). As against this, it took ten days in the atmospheric curing method and 10 hours in the case of curing in the shaft furnace so as to manufacture the same amount of the cold bonded pellets.

As described above, according to the present invention, since the curing gas having a high concentration of carbon dioxide is blown into the green pellets on the travelling grate, the green pellets can be cured by a carbonation bond in a short time. Further, since the green pellets are dried after the curing, adhesion of the pellets to each other can be prevented, and a fuel ratio in a blast furnace operation can be decreased. Furthermore, since gas which does not contain nitrogen is used, nitrogen does not accumulate in the gas during the circular use of the gas. Therefore, the curing gas in which nitrogen accumulates is not required to be removed, and all the amount of carbon dioxide can be used for hydration curing of the green pellets. Moreover, since existing sintering equipment is used as it is, equipment costs are small. Since polution does not occur from the equipment, equipment for desulfurization and for denitrification is not necessary.

What is claimed is:

1. A method for manufacturing cold bonded pellets comprising the steps of:

mixing fine iron ore with binder and pelletizing the mixture of the fine iron ore and the binder to form green pellets;

charging said green pellets into a travelling grate to form a layer of the green pellets on the travelling grate;

blowing a curing gas containing carbon dioxide through the layer of the green pellets on the travelling grate, the green pellets thereby being cured by the curing gas, and the gas having passed through the layer of the green pellets being discharged;

passing the gas having passed through the layer of the green pellets and having been discharged through a dehydrator;

mixing the gas which has passed through the dehydrator with combustion gas to form a gas mixture, the combustion gas being obtained by combusting with oxygen a blast furnace gas, which is generated in a blast furnace process wherein iron ore and coke are charged from the top of a blast furnace into the blast furnace and pure oxygen is blown from tuyeres into the blast furnace, to manufacture pig iron, passing the pellets which have been cured through a drier, blowing said gas mixture through the pellets in the drier, and using the gas mixture passed through the drier as the curing gas.

2. The method of claim 1, wherein manufacturing the green pellets includes mixing fine iron ore, binder and carbonaceous material with each other and pelletizing the mixture thereof into pellets.

3. The method of claim 1, wherein said binder is cement.

4. The method of claim 1, wherein said gas containing carbon dioxide has a concentration of 55 vol. % carbon dioxide or more.

5. The method of claim 4, wherein said gas containing carbon dioxide has a concentration of 90 vol. % carbon dioxide or more.

6. The method of claim 1, wherein said gas containing carbon dioxide has a concentration of 20 vol. % nitrogen or less.

7. The method of claim 1, wherein said gas containing carbon dioxide is blown into the green pellets layer at a flow rate of 0.1 to 1.0 $Nm^3$/sec. for 1 $m^2$ of the area of the grate, $Nm^3$ being the volume of the gas in a normal condition.

8. The method of claim 1, wherein said gas containing carbon dioxide has a concentration of 55 vol. % carbon dioxide or more and 20 vol. % nitrogen or less; and said gas containing carbon dioxide is blown into the travelling grate at a flow rate of 0.1 to 1.0 $Nm^3$/sec. for 1 $m^2$ of the area of the travelling grate, $Nm^3$ being the volume of the gas in a normal condition.

* * * * *